US006582321B2

(12) United States Patent
Galloway et al.

(10) Patent No.: US 6,582,321 B2
(45) **Date of Patent: *Jun. 24, 2003**

(54) GOLF CLUB HEAD

(75) Inventors: J. Andrew Galloway, Escondido, CA (US); Richard C. Helmstetter, Rancho Santa Fe, CA (US); Alan Hocknell, Encinitas, CA (US); Ronald C. Boyce, Cardiff, CA (US); Homer E. Aguinaldo, San Diego, CA (US); Curtis S. Woolley, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 00 days.

This patent is subject to a terminal disclaimer.

(21) Appl. No.: 09/683,906

(22) Filed: Feb. 28, 2002

(65) Prior Publication Data

US 2002/0151379 A1 Oct. 17, 2002

Related U.S. Application Data

(63) Continuation of application No. 09/431,982, filed on Nov. 1, 1999, now Pat. No. 6,354,962.

(51) Int. Cl.[7] ..... A63B 53/04

(52) U.S. Cl. ..... 473/329; 473/342; 473/349; 473/345

(58) Field of Search ..... 473/324, 329, 473/330, 334, 335, 342, 345, 349, 350

(56) References Cited

U.S. PATENT DOCUMENTS

| | | | | |
|---|---|---|---|---|
| 4,502,687 | A | 3/1985 | Kochevar | 273/171 |
| 4,687,205 | A | 8/1987 | Tominaga et al. | |
| 4,930,783 | A | 6/1990 | Antonious | 273/164 |
| 5,094,383 | A | 3/1992 | Anderson et al. | 228/176 |
| 5,172,913 | A | 12/1992 | Bouquet | |
| 5,261,663 | A | 11/1993 | Anderson | |
| 5,261,664 | A | 11/1993 | Anderson | |
| 5,272,802 | A | 12/1993 | Stites, III | |
| 5,344,140 | A | 9/1994 | Anderson | |
| 5,346,217 | A | 9/1994 | Tsuchiya et al. | |
| 5,429,357 | A | 7/1995 | Kobayashi | |
| 5,451,056 | A | 9/1995 | Manning | |
| 5,460,371 | A | 10/1995 | Takeda | |
| 5,464,210 | A | 11/1995 | Davis et al. | 273/73 C |
| 5,464,216 | A | 11/1995 | Hoshi et al. | |

(List continued on next page.)

FOREIGN PATENT DOCUMENTS

| | | |
|---|---|---|
| JP | 05116557 | 4/1993 |
| JP | 07216213 | 8/1995 |
| JP | 09235312 | 7/1997 |
| JP | 10028281 | 2/1998 |

*Primary Examiner*—Paul T. Sewell
*Assistant Examiner*—Thanh P Duong
(74) *Attorney, Agent, or Firm*—Michael A. Catania

(57) ABSTRACT

A golf club having a club head with a striking plate having a thickness in the range of 0.010 to 0.250 inch is disclosed herein. The club head may be composed of three pieces, a face, a sole and a crown. Each of the pieces may be composed of a titanium material. The striking plate of the club head may have an aspect ratio less than 1.7. The striking plate may also have concentric regions of thickness with the thickness portion in the center. The club head may be composed of a titanium material, have a volume in the range of 175 cubic centimeters to 400 cubic centimeters, a weight in the range of 165 grams to 300 grams, and a striking plate surface area in the range of 4.00 square inches to 7.50 square inches. The golf club head may also have a coefficient of restitution greater than 0.8 under test conditions such as the USGA test conditions specified pursuant to Rule 4-1e, Appendix II, of the Rules of Golf for 1998–1999.

5 Claims, 19 Drawing Sheets

U.S. PATENT DOCUMENTS

| | | | | |
|---|---|---|---|---|
| 5,474,296 | A | 12/1995 | Schmidt et al. | 273/167 |
| 5,485,998 | A | 1/1996 | Kobayashi | |
| 5,501,459 | A | 3/1996 | Endo | |
| 5,527,034 | A | 6/1996 | Ashcraft et al. | |
| 5,556,097 | A | 9/1996 | Endo et al. | |
| 5,776,011 | A | 7/1998 | Su et al. | |
| 5,788,584 | A | 8/1998 | Parente et al. | |
| 5,797,807 | A | 8/1998 | Moore | |
| 5,830,084 | A | 11/1998 | Kosmatka | 473/349 |
| 5,888,148 | A | 3/1999 | Allen | 473/290 |
| 6,048,278 | A | 4/2000 | Meyer et al. | 473/345 |
| 6,152,833 | A | 11/2000 | Werner et al. | 473/324 |
| 6,165,081 | A | 12/2000 | Chou | 473/329 |
| 6,203,449 | B1 | 3/2001 | Kenmi | 473/346 |
| 6,248,025 | B1 | 6/2001 | Murphy et al. | 473/324 |
| 6,354,962 | B1 * | 3/2002 | Galloway et al. | 473/342 |
| 6,368,234 | B1 * | 4/2002 | Galloway | 473/349 |
| 6,386,990 | B1 * | 5/2002 | Reyes et al. | 473/344 |
| 6,398,666 | B1 * | 6/2002 | Evans et al. | 473/345 |
| 6,440,011 | B1 * | 8/2002 | Hocknell et al. | 473/342 |
| 6,491,592 | B2 * | 12/2002 | Cackett et al. | 473/342 |

* cited by examiner

GOLF CLUB HEAD

CROSS REFERENCES TO RELATED APPLICATIONS

The Present Application is a continuation application of U.S. patent application Ser. No. 09/431,982, filed Nov. 1, 1999, now U.S. Pat. No. 6,354,962.

FEDERAL RESEARCH STATEMENT

[Not Applicable]

BACKGROUND OF INVENTION

1. Field of the Invention

The present invention relates to a golf club head. More specifically, the present invention relates to a golf club head with face component for a more efficient transfer of energy to a golf ball at impact.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inches), as opposed to the small deformations of the metallic club face (0.025 to 0.050 inches). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches. Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Finally, Aizawa, U.S. Pat. No. 5,346,216 for a Golf Club Head, discloses a face plate having a curved ball hitting surface.

The Rules of Golf, established and interpreted by the United States Golf Association (USGA) and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

Although the prior art has disclosed many variations of face plates, the prior art has failed to provide a face plate with a high coefficient of restitution composed of a thin material.

SUMMARY OF INVENTION

One aspect of the present invention is a golf club head having a striking plate having a thickness in the range of 0.010 inch to 0.250 inch, and having a coefficient of restitution of at least 0.83 under test conditions, such as those specified by the USGA. The standard USGA conditions for measuring the coefficient of restitution is set forth in the *USGA Procedure for Measuring the Velocity Ratio of a Club Head for Conformance to Rule* 4-1e, Appendix II. Revision I. Aug. 4, 1998 and Revision O, Jul. 6, 1998, available from the USGA.

Another aspect of the present invention is a golf club head including a face member, a crown and a sole. The face member is composed of a material selected from titanium, titanium alloys, steels, vitreous metals, composites and ceramics. The face member includes a striking plate for striking a golf ball, a face extension and an interior tubing. The face extension extends laterally inward from a perimeter of the striking plate. The interior tubing receives a shaft and engages an upper portion of the face extension and a lower portion of the face extension. The crown is secured to the upper portion of the face extension at a varying distance from the striking plate. The sole plate is secured to the lower portion of the face extension at a varying distance from the striking plate.

Yet another aspect of the present invention is a golf club head having a striking plate with an aspect ratio no greater than 1.7. The aspect ratio is the ratio of width of the face to the height of the face. Normally, the aspect ratios of club head faces are relatively greater than 1.7. For example, the aspect ratio of the original GREAT BIG BERTHA® driver from Callaway Golf Company of Carlsbad, Calif. was 1.9. As described in greater detail below, the smaller aspect ratio of the striking plate of the club head of the present invention allows for greater compliance and thus a larger coefficient of restitution.

Yet another aspect of the present invention is a golf club head including a body composed of a titanium material and having a volume in the range of 175 cubic centimeters to 400 cubic centimeters, and preferably 260 cubic centimeters to 350 cubic centimeters, and most preferably in the range of 300 cubic centimeters to 310 cubic centimeters, a weight in the range of 160 grams to 300 grams, preferably 175 grams to 225 grams, and a face having a surface area in the range of 4.50 square inches to 5.50 square inches, and preferably in the range of 4.00 square inches to 7.50 square inches.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
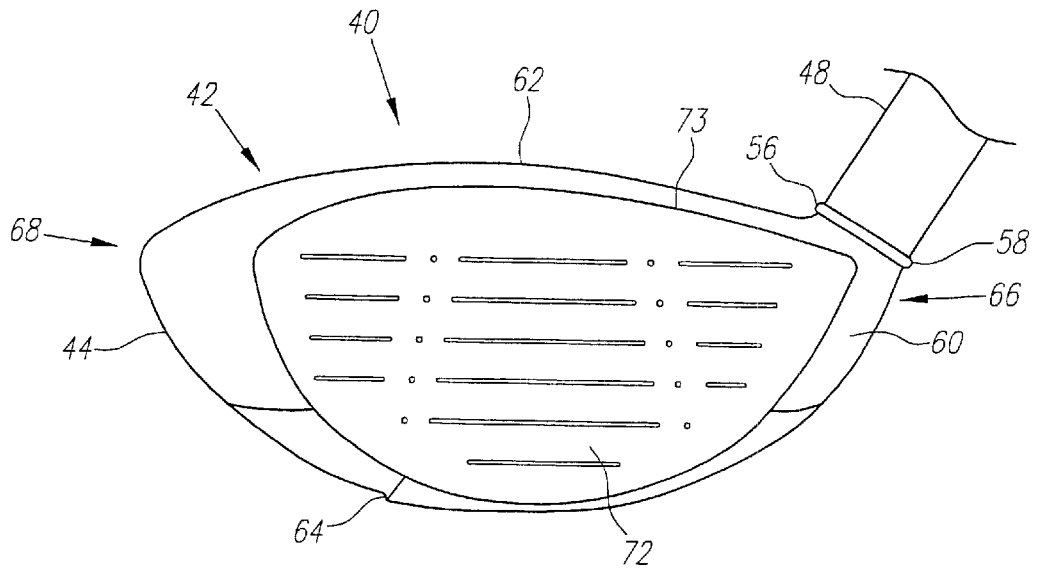
FIG. 1 is a front view of the golf club of the present invention.

The present invention is directed at a golf club head having a striking plate that is thin and has a high coefficient of restitution thereby enabling for greater distance of a golf ball hit with the golf club head of the present invention. The coefficient of restitution (also referred to herein as "COR") is determined by the following equation:

$$e=v_2-v_1/U_1-U_2$$

wherein $U_1$ is the club bead velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

As shown in FIGS. 1–5, a golf club is generally designated 40. The golf club 40 has a golf club head 42 with a body 44 and a hollow interior, not shown. Engaging the club head 42 is a shaft 48 that has a grip 50, not shown, at a butt end 52 and is inserted into a hosel 54 at a tip end 56. An O-ring 58 may encircle the shaft 48 at an aperture 59 to the hosel 54.

The body 44 of the club head 42 is generally composed of three sections, a face member 60, a crown 62 and a sole 64. The club head 42 may also be partitioned into a heel section 66 nearest the shaft 48, a toe section 68 opposite the heel section 66, and a rear section 70 opposite the face member 60.

Figure 1A:
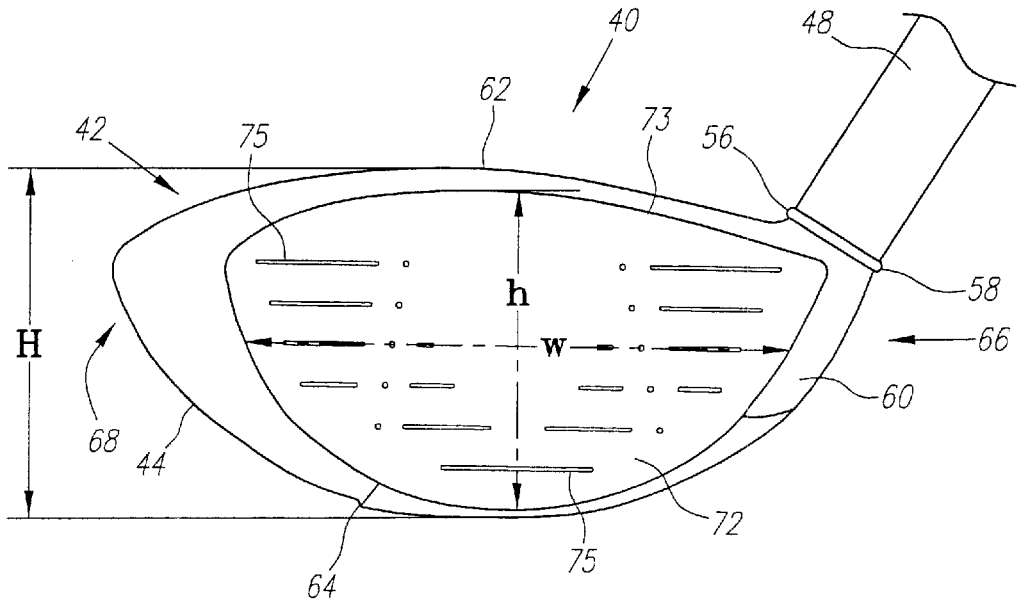
FIG. 1A is a front view of an alternative embodiment of the golf club of the present invention.
Figure 3:
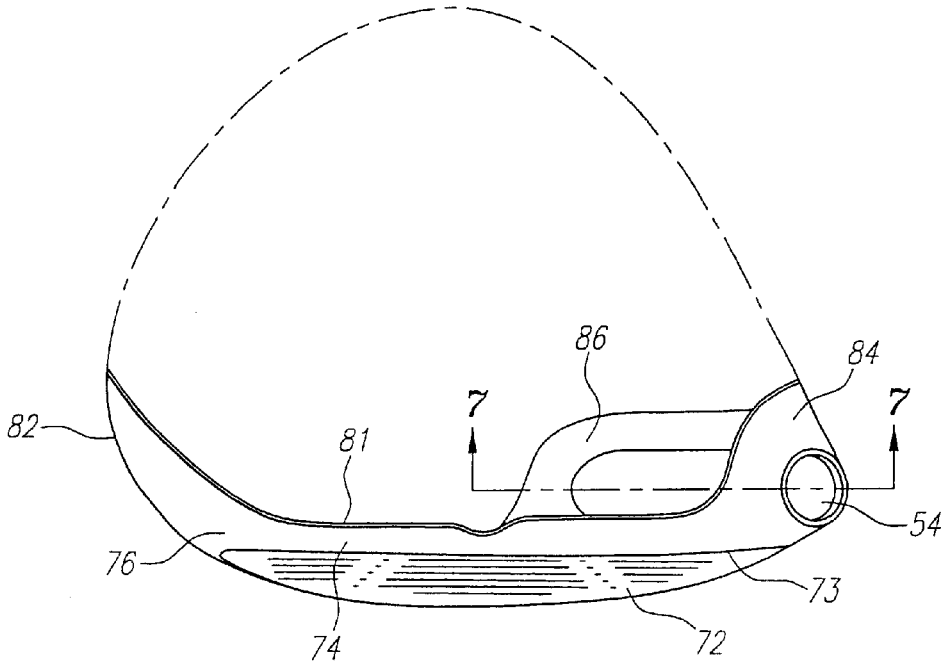
FIG. 3 is a top plan isolated view of the face member of the golf club head of the present invention with the crown in phantom lines.

The face member 60 is generally composed of a single piece of metal, and is preferably composed of a forged metal material. More preferably, the forged metal material is a forged titanium material. However, those skilled in the relevant art will recognize that the face member may be composed of other materials such as steels, vitreous metals, ceramics, composites, carbon, carbon fibers and other fibrous materials without departing from the scope and spirit of the present invention. The face member 60 generally includes a face plate (also referred to herein as a striking plate) 72 and a face extension 74 extending laterally inward from the perimeter of the face plate 72. The face plate 72 has a plurality of scorelines 75 thereon. An alternative embodiment of the face plate 72 is illustrated in FIG. 1A which has a different scoreline pattern. A more detailed explanation of the scorelines 75 is set forth in U.S. Pat. No. 6,443,856, entitled Contoured Scorelines For The Face Of A Golf Club, and incorporated by reference in its entirety. The face extension 74 generally includes an upper lateral extension 76, a lower lateral extension 78, a heel wall 80 and a toe wall 82.

Figure 2:
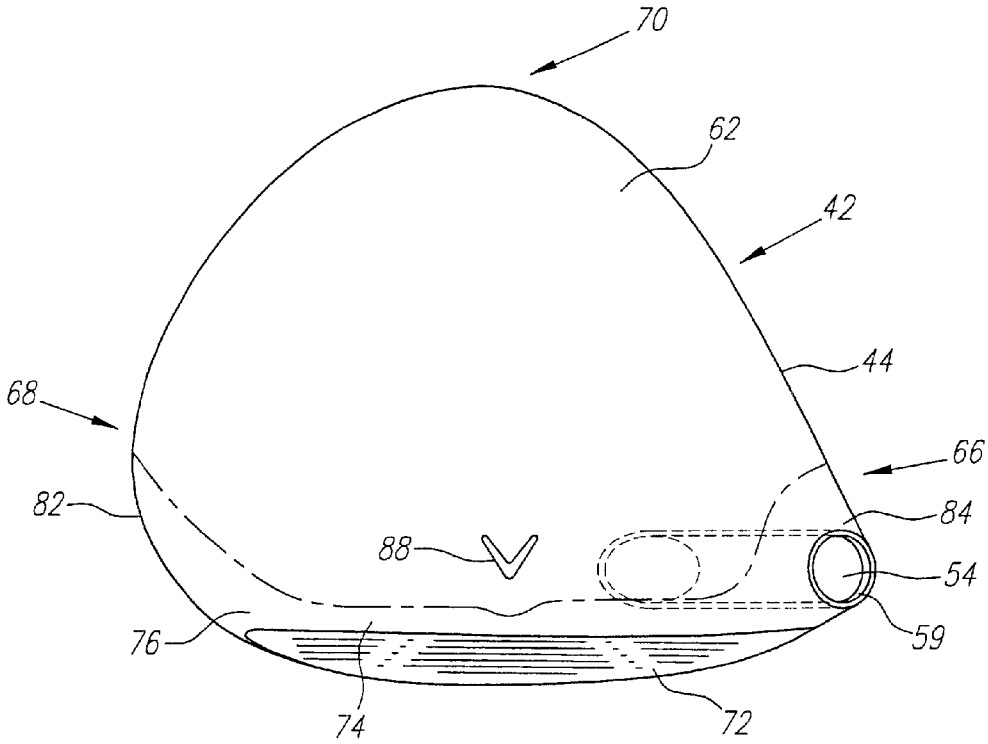
FIG. 2 is a top plan view of golf club head of FIG. 1.
Figure 2A:
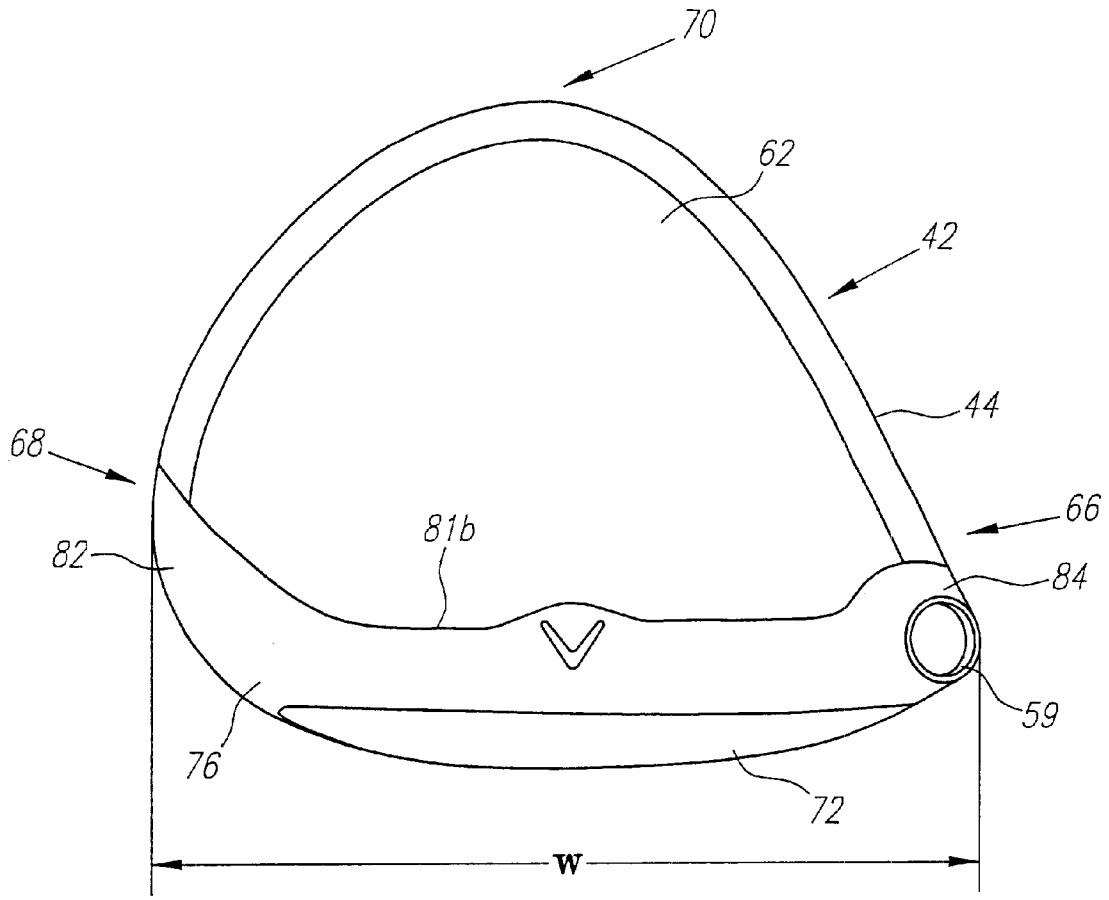
FIG. 2A is a top plan view of an alternative embodiment of the golf club of the present invention.
Figure 4:
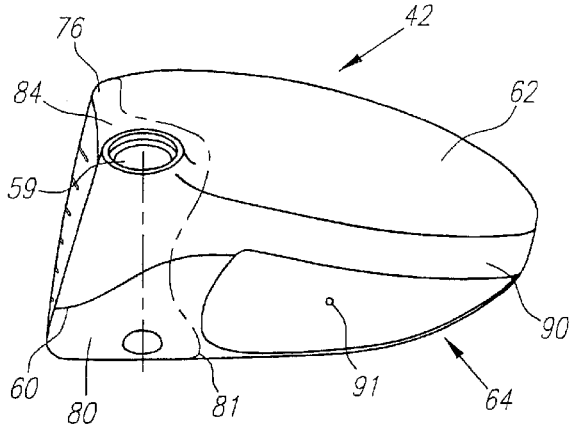
FIG. 4 is a side plan view of the golf club head of the present invention.
Figure 5:
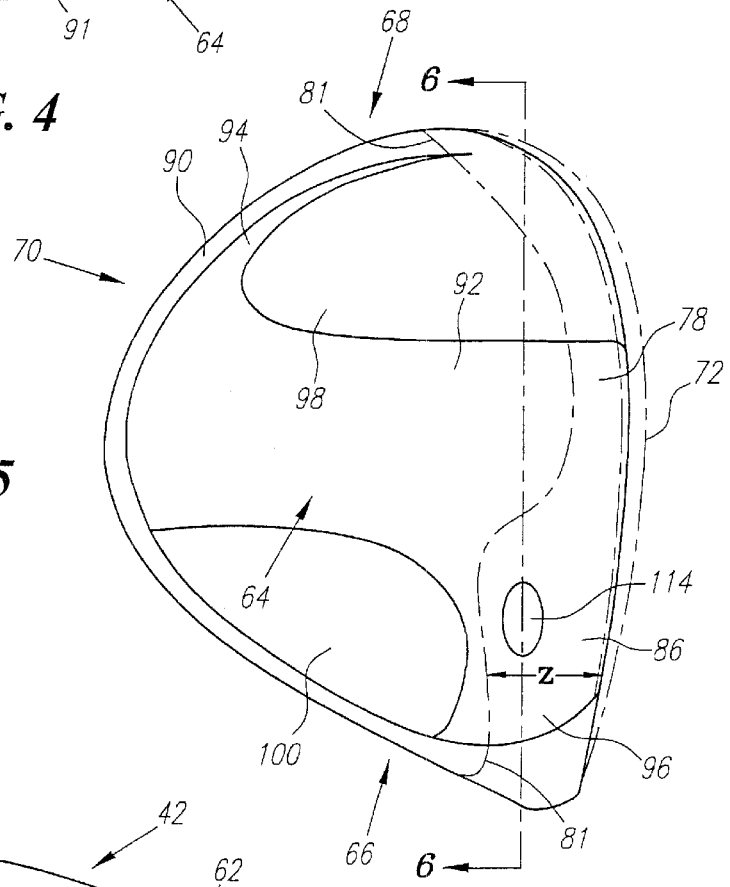
FIG. 5 is a bottom view of the golf club head of the present invention.
Figure 4A:
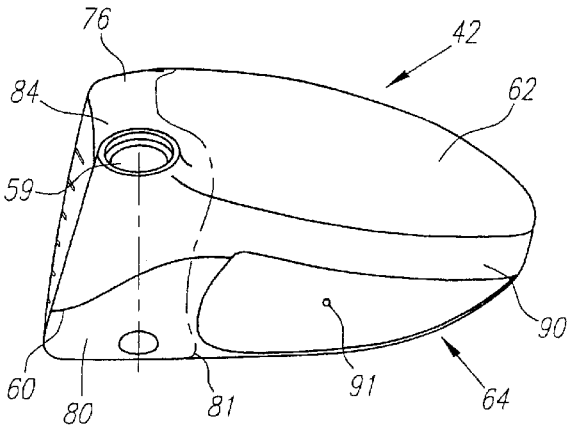
FIG. 4A is a side plan view of an alternative embodiment of the golf club head of the present invention.

The upper lateral extension 76 extends inward, toward the hollow interior 46, a predetermined distance to engage the crown 62. In a preferred embodiment, the predetermined distance ranges from 0.2 inch to 1.0 inch, as measured from the perimeter 73 of the face plate 72 to the edge of the upper lateral extension 76. Unlike the prior art which has the crown engage the face plate perpendicularly, the present invention has the face member 60 engage the crown 62 along a substantially horizontal plane. Such engagement enhances the flexibility of the face plate 72 allowing for a greater coefficient of restitution. The crown 62 and the upper lateral extension 76 are secured to each other through welding or the like along the engagement line 81. As illustrated in FIG. 2A, in an alternative embodiment, the upper lateral extension 76 engages the crown 62 at a greater distance inward thereby resulting in a weld that is more rearward from the stresses of the face plate 72 than that of the embodiment of FIG. 2.

The uniqueness of the present invention is further demonstrated by a hosel section 84 of the face extension 74 that encompasses the aperture 59 leading to the hosel 54. The hosel section 84 has a width $w_1$ that is greater than a width $w_2$ of the entirety of the upper lateral extension 76. The hosel section 84 gradually transitions into the heel wall 80. The heel wall 80 is substantially perpendicular to the face plate 72, and the heel wall 80 covers the hosel 54 before engaging a ribbon 90 and a bottom section 91 of the sole 64. The heel wall 80 is secured to the sole 64, both the ribbon 90 and the bottom section 91, through welding or the like.

At the other end of the face member 60 is the toe wall 82 which arcs from the face plate 72 in a convex manner. The toe wall 82 is secured to the sole 64, both the ribbon 90 and the bottom section 91, through welding or the like.

The lower lateral extension 78 extends inward, toward the hollow interior 46, a predetermined distance to engage the sole 64. In a preferred embodiment, the predetermined distance ranges from 0.2 inch to 1.0 inch, as measured from the perimeter 73 of the face plate 72 to the end of the lower lateral extension 78. Unlike the prior art which has the sole plate engage the face plate perpendicularly, the present invention has the face member 60 engage the sole 64 along a substantially horizontal plane. This engagement moves the weld heat affected zone rearward from a strength critical crown/face plate radius region. Such engagement enhances the flexibility of the face plate 72 allowing for a greater coefficient of restitution. The sole 64 and the lower lateral extension 78 are secured to each other through welding or the like, along the engagement line 81. The uniqueness of the present invention is further demonstrated by a bore section 86 of the face extension 74 that encompasses a bore 114 in the sole 64 leading to the hosel 54. The bore section 86 has a width $w_3$ that is greater than a width $w_4$ of the entirety of the lower lateral extension 78. The bore section 86 gradually transitions into the heel wall 80.

The crown 62 is generally convex toward the sole 64, and engages the ribbon 90 of sole 64 outside of the engagement with the face member 60. The crown 62 may have a chevron decal 88, or some other form of indicia scribed therein that may assist in alignment of the club head 42 with a golf ball. The crown 62 preferably has a thickness in the range of 0.025 to 0.060 inch, and more preferably in the range of 0.035 to 0.043 inch, and most preferably has a thickness of 0.039 inches. The crown 62 is preferably composed of a hot formed or coined material such as a sheet titanium. However, those skilled in the pertinent art will recognize that other materials or forming processes may be utilized for the crown 62 without departing from the scope and spirit of the present invention.

The sole 64 is generally composed of the bottom section 91 and the ribbon 90 which is substantially perpendicular to the bottom section 91. The bottom section 91 is generally convex toward the crown 62. The bottom section has a medial ridge 92 with a first lateral extension 94 toward the toe section 68 and a second lateral extension 96 toward the heel section 66. The medial ridge 92 and the first lateral extension 94 define a first convex depression 98, and the medial ridge 92 and the second lateral extension 96 define a second convex depression 100. A more detailed explanation of the sole 64 is set forth in U.S. Pat. No. 6,007,433, filed on Apr. 2, 1998, for a Sole Configuration For Golf Club Head, which is hereby incorporated by reference in its entirety. The sole 64 preferably has a thickness in the range of 0.025 to 0.060 inch, and more preferably 0.047 to 0.055 inch, and most preferably has a thickness of 0.051 inch. The sole 64 is preferably composed of a hot formed or coined metal material such as a sheet titanium material. However, those skilled in the pertinent art will recognize that other materials and forming processes may be utilized for the sole 64 without departing from the scope and spirit of the present invention.

Figure 6:
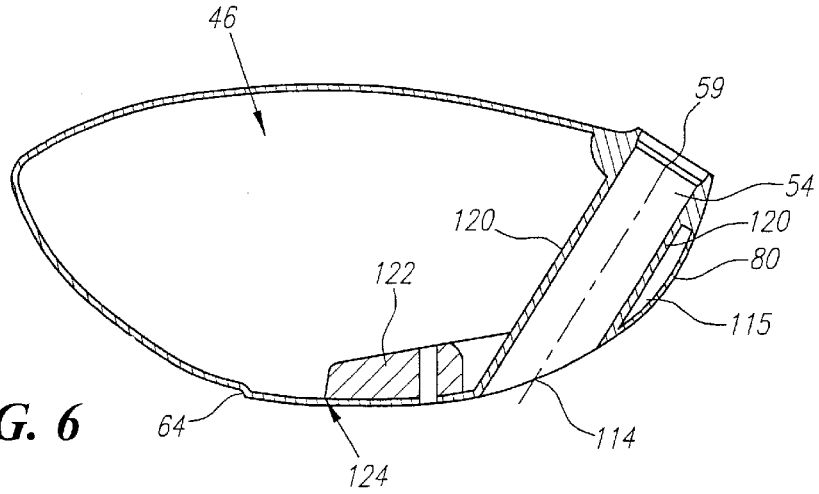
FIG. 6 is a cross-sectional view along line 6—6 of FIG. 5.
Figure 7:
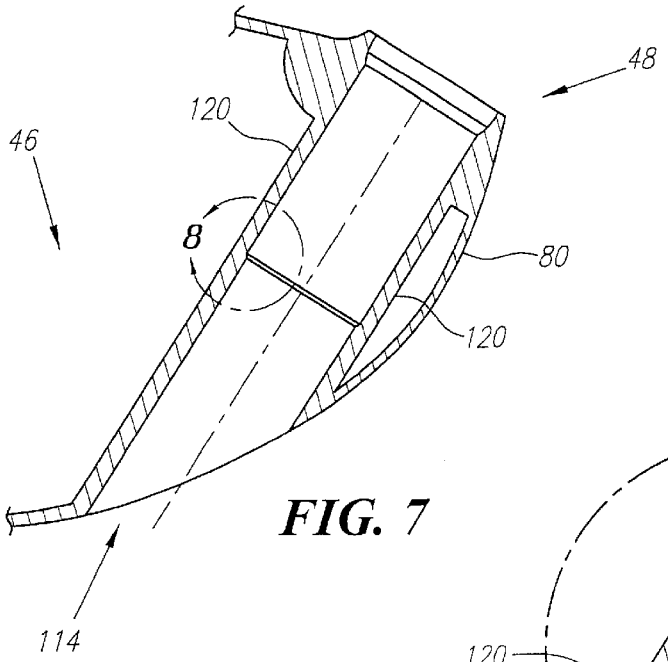
FIG. 7 is a cross-sectional view along line 7—7 of FIG. 3 illustrating the hosel of the golf club head present invention.
Figure 8:
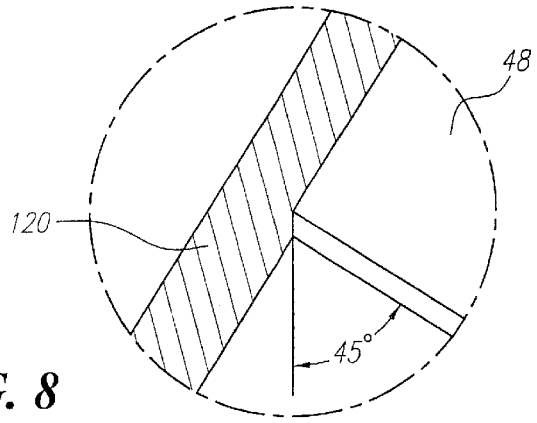
FIG. 8 is an enlarged view of circle 8 of FIG. 7.

FIGS. 6–8 illustrate the hollow interior 46 of the club head 42 of the present invention. The hosel 54 is disposed within the hollow interior 46, and is located as a component of the face member 60. The hosel 54 may be composed of a similar material to the face member 60, and is secured to the face member 60 through welding or the like. The hosel 54 is located in the face member 60 to concentrate the weight of the hosel 54 toward the face plate 72, near the heel section 66 in order to contribute to the ball striking mass of the face plate 72. A hollow interior 118 of the hosel 54 is defined by a hosel wall 120 that forms a cylindrical tube between the bore 114 and the aperture 59. In a preferred embodiment, the hosel wall 120 does not engage the heel wall 80 thereby leaving a void 115 between the hosel wall 120 and the heel wall 80. The shaft 48 is disposed within the hosel 54. Further, the hosel 54 is located rearward from the face plate 72 in order to allow for compliance of the face plate 72 during impact with a golf ball. In one embodiment, the hosel 54 is disposed 0.125 inch rearward from the face plate 72.

Optional dual weighting members 122 and 123 may also be disposed within the hollow interior 46 of the club head 42. In a preferred embodiment, the weighting members 122 and 123 are disposed on the sole 64 in order to the lower the center of gravity of the golf club 40. The weighting members 122 and 123, not shown, may have a shape configured to the contour of the sole 64. However, those skilled in the pertinent art will recognize that the weighting member may be placed in other locations of the club head 42 in order to influence the center of gravity, moment of inertia, or other inherent properties of the golf club 40. The weighting members 122 and 123 are preferably a pressed and sintered powder metal material such as a powder titanium material. Alternatively, the weighting members 122 and 123 may be cast or machined titanium chips. Yet further, the weighting members 122 and 123 may be a tungsten screw threadingly engaging an aperture 124 of the sole 64. Although titanium and tungsten have been used as exemplary materials, those skilled in the pertinent art will recognize that other high density materials may be utilized as an optional weighting member without departing from the scope and spirit of the present invention.

Figure 9:
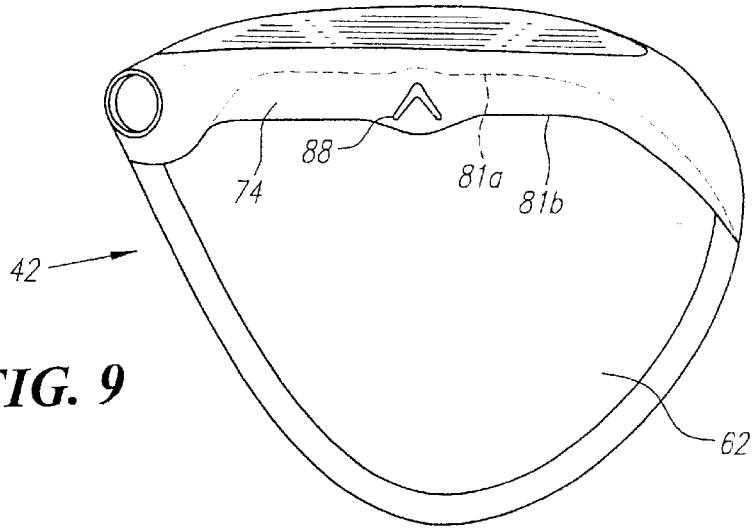
FIG. 9 is a top plan view of overlaid embodiments of the face member of the golf club head of the present invention.
Figure 10:
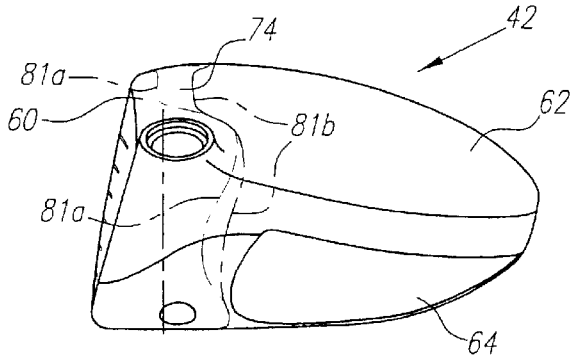
FIG. 10 is a side view of overlaid embodiments of the face member of the golf club head of the present invention.
Figure 11:
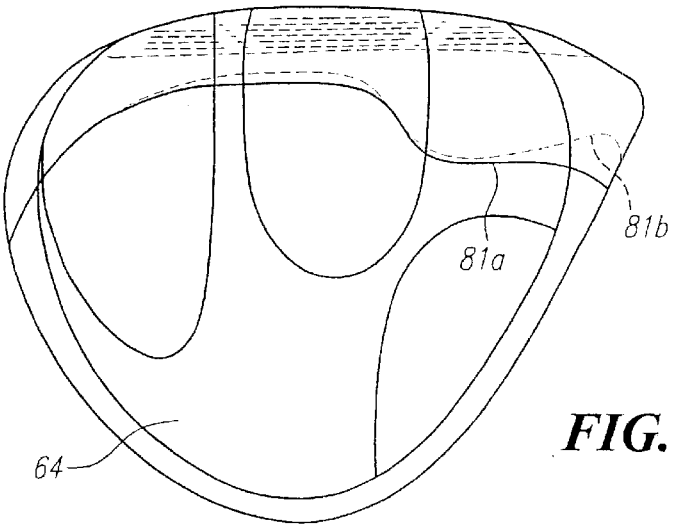
FIG. 11 is a bottom plan view of overlaid embodiments of the face member of the golf club head of the present invention.

FIGS. 9–11 illustrate variations in the engagement line 81*a* or 81*b*. The engagement line 81*b* illustrates a variation of the face extension 74 of the face member 60. The variation has the engagement line located rearward of the chevron 88. The engagement line 81*b* is the preferred engagement line.

Figure 12:
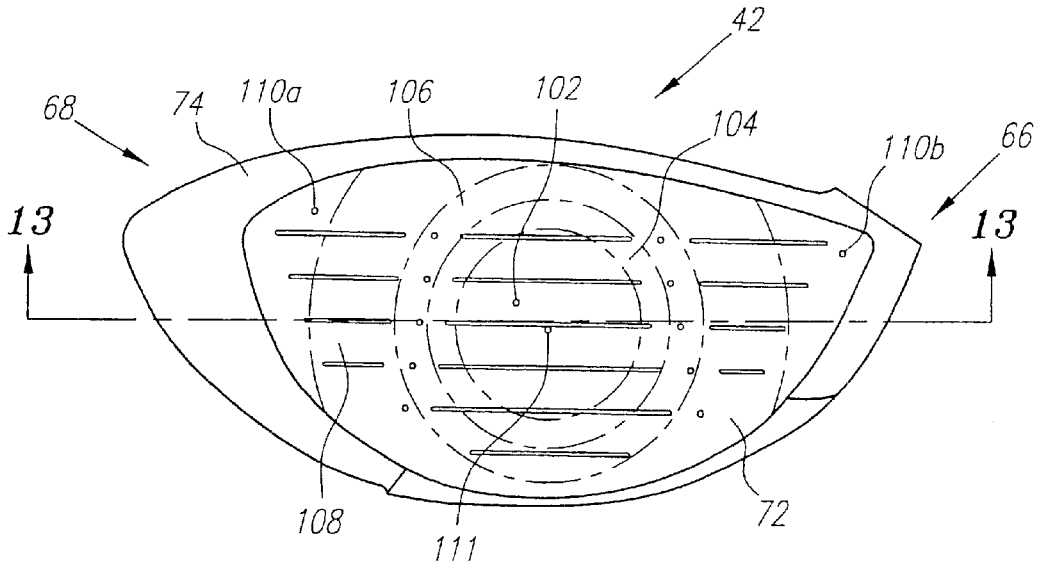
FIG. 12 is a front view of the golf club head of the present invention illustrating the variations in thickness of the striking plate.
Figure 12A:
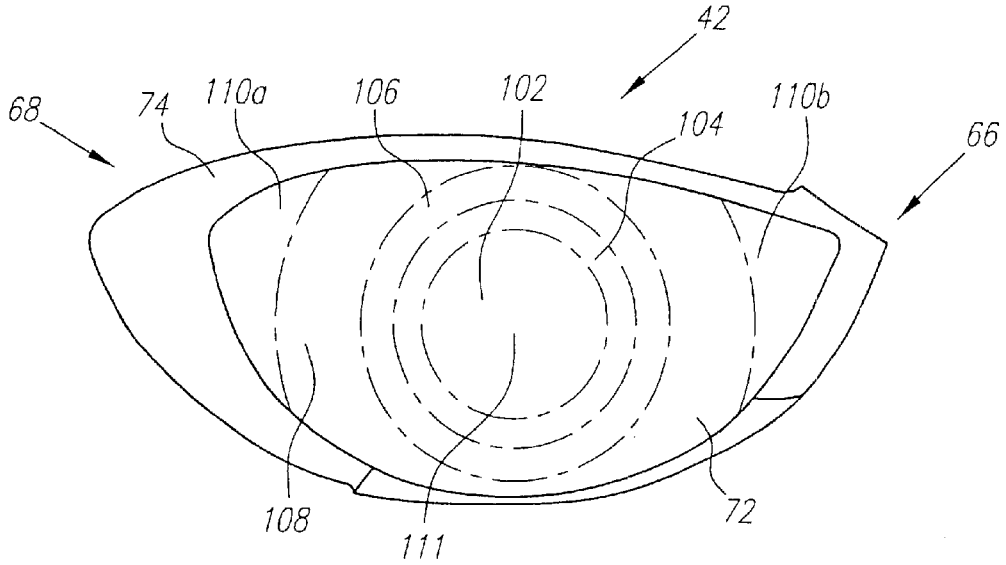
FIG. 12A is a front view of an alternative golf club head of the present invention illustrating the variations in thickness of the striking plate.
Figure 13:
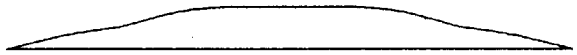
FIG. 13 is a cross-sectional view along line 13—13 of FIG. 12 showing face thickness variation.

FIGS. 12, 12A and 13 illustrate embodiments of the present invention having a variation in the thickness of the face plate 72. The face plate or striking plate 72 is partitioned into elliptical regions, each having a different thickness. A central elliptical region 102 preferably has the greatest thickness that ranges from 0.110 inch to 0.090 inch, preferably from 0.103 inch to 0.093 inch, and is most preferably 0.095 inch. A first concentric region 104 preferably has the next greatest thickness that ranges from 0.097 inch to 0.082 inch, preferably from 0.090 inch to 0.082 inch, and is most preferably 0.086 inch. A second concentric region 106 preferably has the next greatest thickness that ranges from 0.094 inch to 0.070 inch, preferably from 0.078 inch to 0.070 inch, and is most preferably 0.074 inch. A third concentric region 108 preferably has the next greatest thickness that ranges from 0.090 inch to 0.07 inch. A periphery region 110 preferably has the next greatest thickness that ranges from 0.069 inch to 0.061 inch. The periphery region includes toe periphery region 110*a* and heel periphery region 110*b*. The variation in the thickness of the face plate 72 allows for the greatest thickness to be distributed in the center 111 of the face plate 72 thereby enhancing the flexibility of the face plate 72 which corresponds to a greater coefficient of restitution.

In an alternative embodiment, the striking plate 72 is composed of a vitreous metal such as iron-boron, nickel-copper, nickel-zirconium, nickel-phosphorous, and the like. These vitreous metals allow for the striking plate 72 to have a thickness as thin as 0.055 inch. Preferably, the thinnest portions of such a vitreous metal striking plate would be in the periphery regions 110*a* and 110*b*, although the entire striking plate 72 of such a vitreous metal striking plate 72 could have a uniform thickness of 0.055 inch.

Yet in further alternative embodiments, the striking plate 72 is composed of ceramics, composites or other metals. Further, the face plate or striking plate 72 may be an insert for a club head such as wood or iron. Additionally, the thinnest regions of the striking plate 72 may be as low as 0.010 inch allowing for greater compliance and thus a higher coefficient of restitution.

Figure 15:
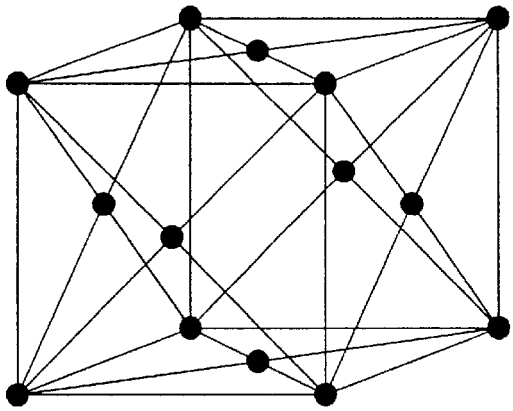
FIG. 15 is a perspective view of a face centered cubic model.
Figure 16:
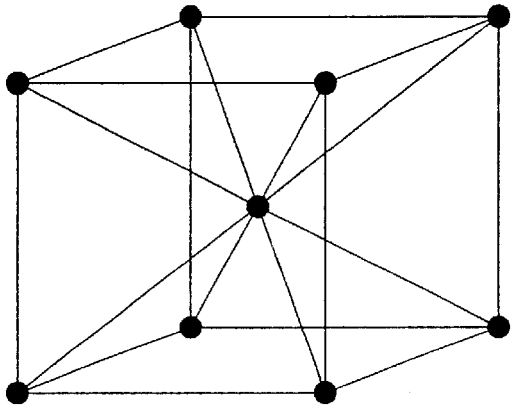
FIG. 16 is a perspective view of a body centered cubic model.

The coefficient of restitution of the club head 42 of the present invention under standard USGA test conditions with a given ball ranges from 0.80 to 0.93, preferably ranges from 0.83 to 0.883 and is most preferably 0.87. The microstructure of titanium material of the face member 60 has a face center cubic (FCC) microstructure as shown in FIG. 15, and a body center cubic (BCC) microstructure as shown in FIG. 16. The FCC microstructure is associated with alpha-titanium, and the BCC microstructure is associated with beta-titanium.

Figure 14:
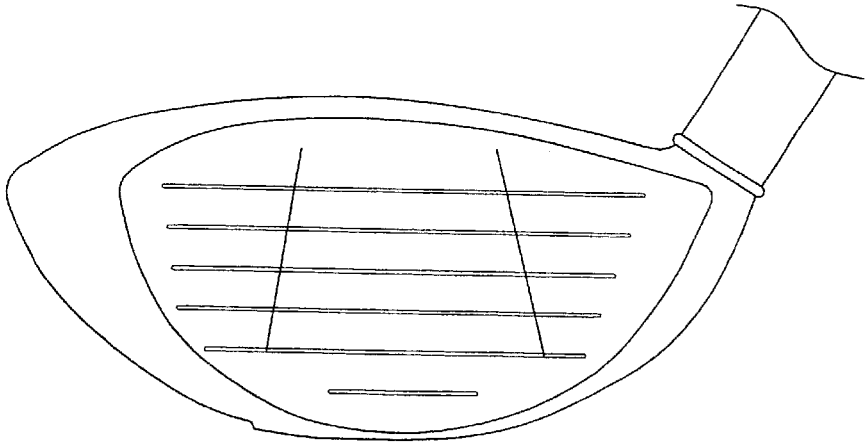
FIG. 14 is a front plan view of a BIG BERTHA® WARBIRD® driver of the prior art.

Additionally, the face plate 72 of the present invention has a smaller aspect ratio than face plates of the prior art (one example of the prior art is shown in FIG. 14). The aspect ratio as used herein is defined as the width, w, of the face divided by the height, h, of the face, as shown in FIG. 1A. In one embodiment, the width w is 78 millimeters and the height h is 48 millimeters giving an aspect ratio of 1.635. In conventional golf club heads, the aspect ratio is usually much greater than 1. For example, the original GREAT BIG BERTHA® driver had an aspect ratio of 1.9. The face of the present invention has an aspect ratio that is no greater than 1.7. The aspect ratio of the present invention preferably ranges from 1.0 to 1.7. One embodiment has an aspect ratio of 1.3. The face of the present invention is more circular than faces of the prior art. The face area of the face plate 72 of the present invention ranges 4.00 square inches to 7.50 square inches, more preferably from 4.95 square inches to 5.1 square inches, and most preferably from 4.99 square inches to 5.06 square inches.

The club head 42 of the present invention also has a greater volume than a club head of the prior art while maintaining a weight that is substantially equivalent to that of the prior art. The volume of the club head 42 of the present invention ranges from 175 cubic centimeters to 400 cubic centimeters, and more preferably ranges from 300 cubic centimeters to 310 cubic centimeters. The weight of the club head 42 of the present invention ranges from 165 grams to 300 grams, preferably ranges from 175 grams to 225 grams, and most preferably from 188 grams to 195 grams. The depth of the club head from the face plate 72 to the rear section of the crown 62 preferably ranges from 3.606 inches to 3.741 inches. The height, H, of the club head 42, as measured while in striking position, preferably ranges from 2.22 inches to 2.27 inches, and is most preferably 2.24 inches. The width, W, of the club head 42 from the toe section 68 to the heel section 66 preferably ranges from 4.5 inches to 4.6 inches.

Figure 17:
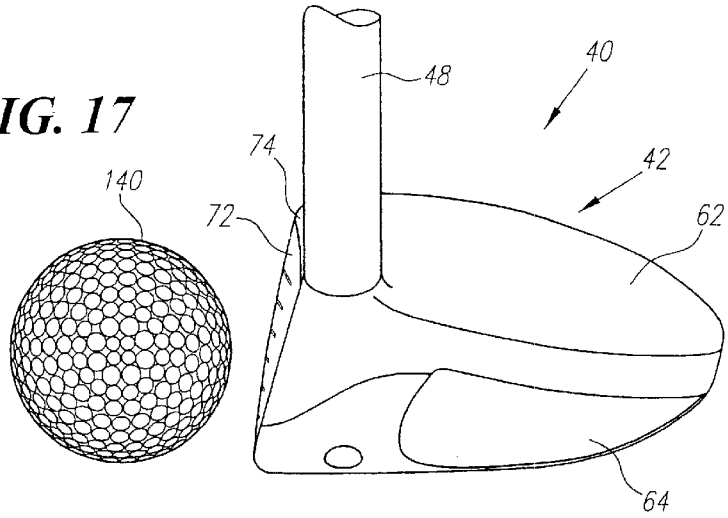
FIG. 17 is a side view of a golf club head of the present invention immediately prior to impact with a golf ball.
Figure 18:
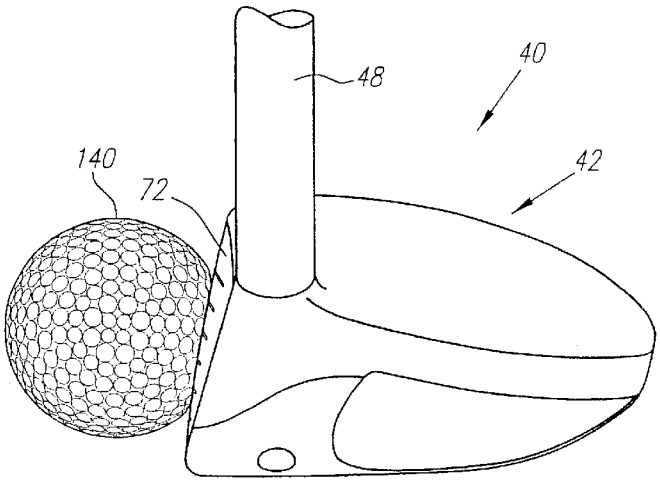
FIG. 18 is a side view of a golf club head of the present invention during impact with a golf ball.
Figure 19:
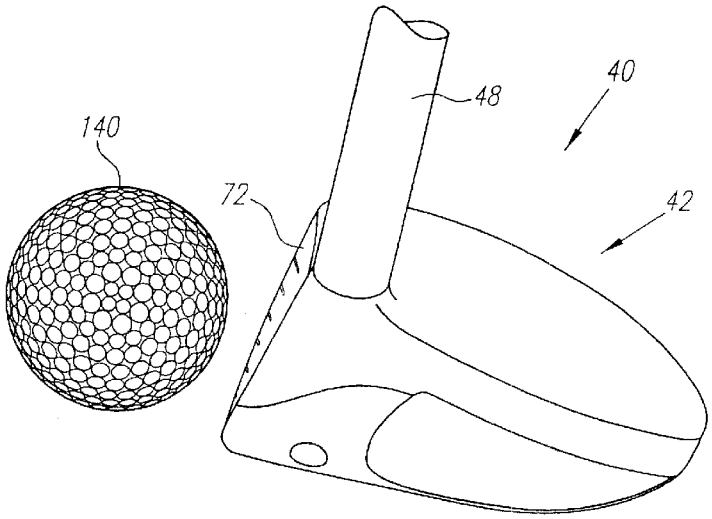
FIG. 19 is a side view of a golf club head of the present invention immediately after impact with a golf ball.

As shown in FIGS. 17–19, the flexibility of the face plate 72 allows for a greater coefficient of restitution. At FIG. 17, the face plate 72 is immediately prior to striking a golf ball 140. At FIG. 18, the face plate 72 is engaging the golf ball, and deformation of the golf ball 140 and face plate 72 is illustrated. At FIG. 19, the golf ball 140 has just been launched from the face plate 72.

The golf club 42 of the present invention was compared to a golf club head shaped similar to the original GREAT BIG BERTHA® driver to demonstrate how variations in the aspect ratio, thickness and area will effect the COR and stresses of the face plate 72. However, the GREAT BIG BERTHA® reference had a uniform face thickness of 0.110 inch which is thinner than the original GREAT BIG BERTHA® driver from Callaway Golf Company. The GREAT BIG BERTHA® reference had a COR value of 0.830 while the original GREAT BIG BERTHA® driver had a COR value of 0.788 under test conditions, such as the USGA test conditions specified pursuant to Rule 4-1e, Appendix II of the Rules of Golf for 1998–1999. For a one-hundred mph face center impact for the GREAT BIG BERTHA® reference, the peak stresses were 40 kilopounds per square inch (ksi) for the face-crown, 49 ksi for the face-sole and 29 ksi for the face-center. The face deflection for the GREAT BIG BERTHA® reference at one-hundred mph was 1.25 mm. FIGS. 20–29 illustrate graphs related to these parameters using the GREAT BIG BERTHA® reference as a base. The face-crown refers to the upper lateral extension 76, the face-sole refers to the lower lateral extension 78, and the face-center refers to the center of the face plate 72.

Figure 20:
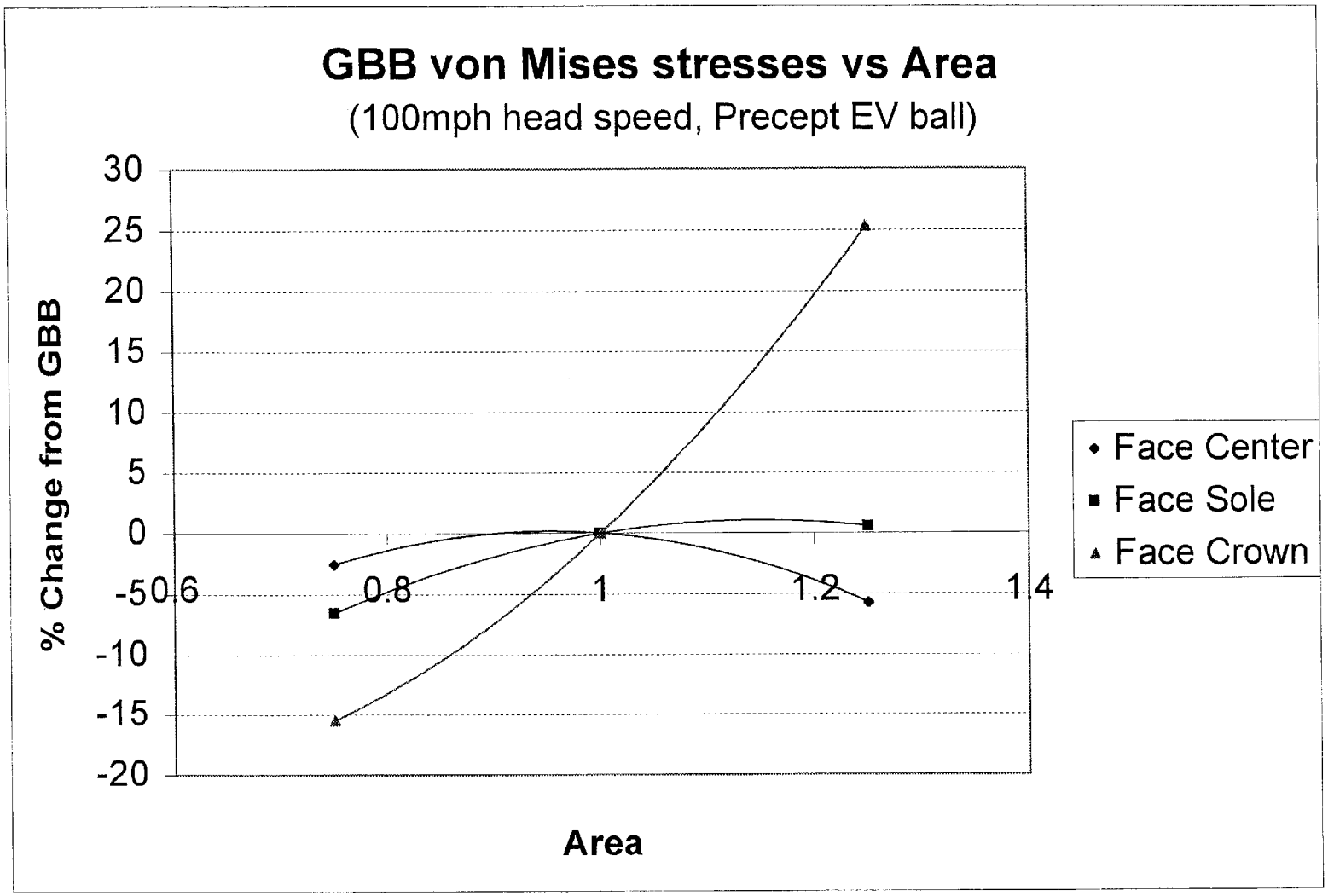
FIG. 20 is a graph of the percentage change in von Mises stresses using a GREAT BIG BERTHA® shaped golf club as a base reference versus Area for the face center, the face sole and the face crown of the golf club head of the present invention.

FIG. 20 illustrates the percent changes from the stresses on a GREAT BIG BERTHA® reference versus changes in the area of the face plate 72. As illustrated in the graph, as the area increases the stress on the face-crown increases, and as the area decreases the stress on the face-crown decreases. The stresses on the face-center and the face-sole remain relatively constant as the area of the face plate 72 increases or decreases.

Figure 21:
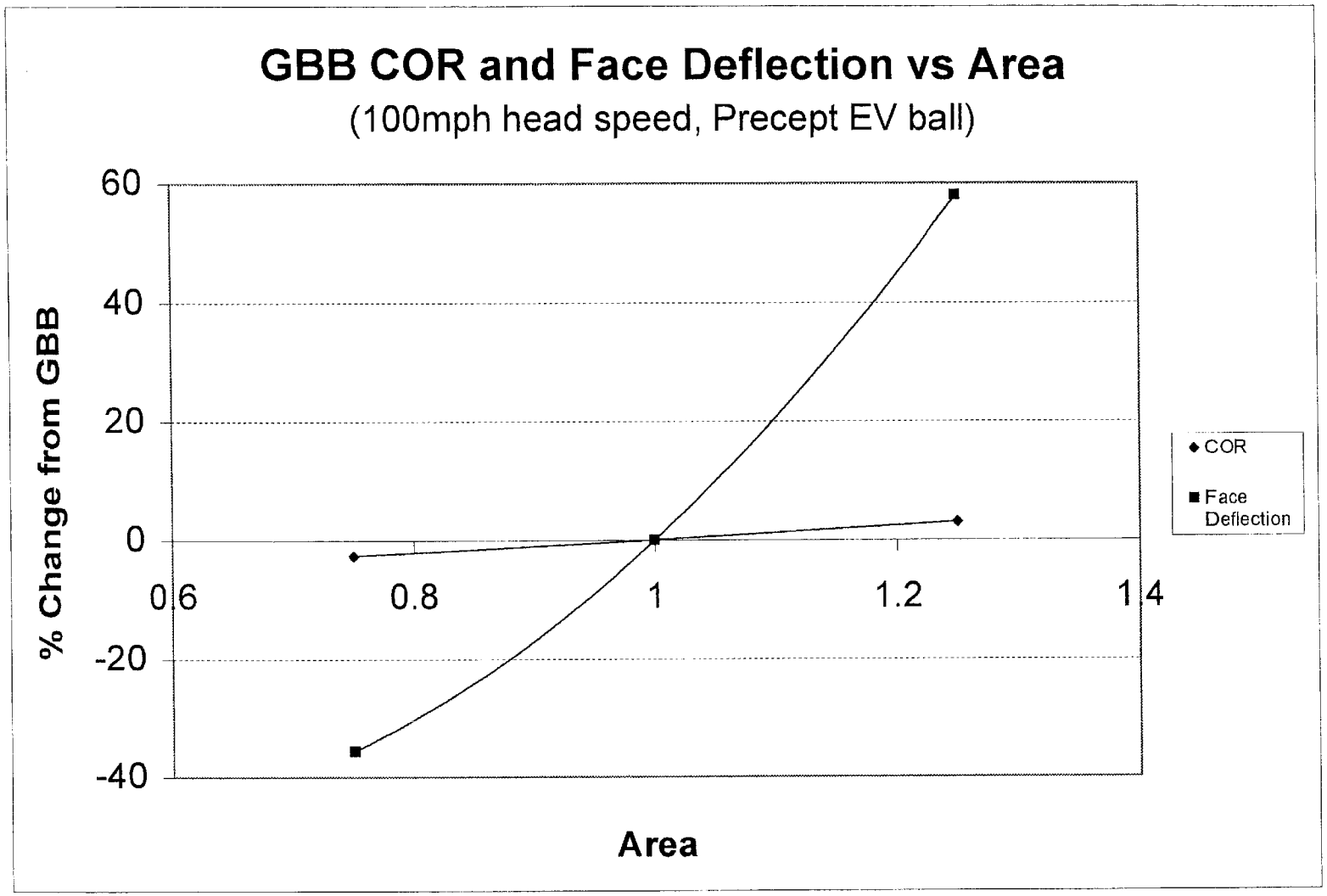
FIG. 21 is a graph of the percentage change in COR and Face Deflection using a GREAT BIG BERTHA® shaped golf club as a base reference versus Area.

FIG. 21 illustrates how changes in the area will affect the COR and face deflection. Small changes in the area will greatly affect the deflection of the face plate 72 while changes to the COR, although relatively smaller percentage changes, are significantly greater in effect. Thus, as the area becomes larger, the face deflection will increase while the COR will increase slightly, but with a significant effect relative to the face deflection.

Figure 22:
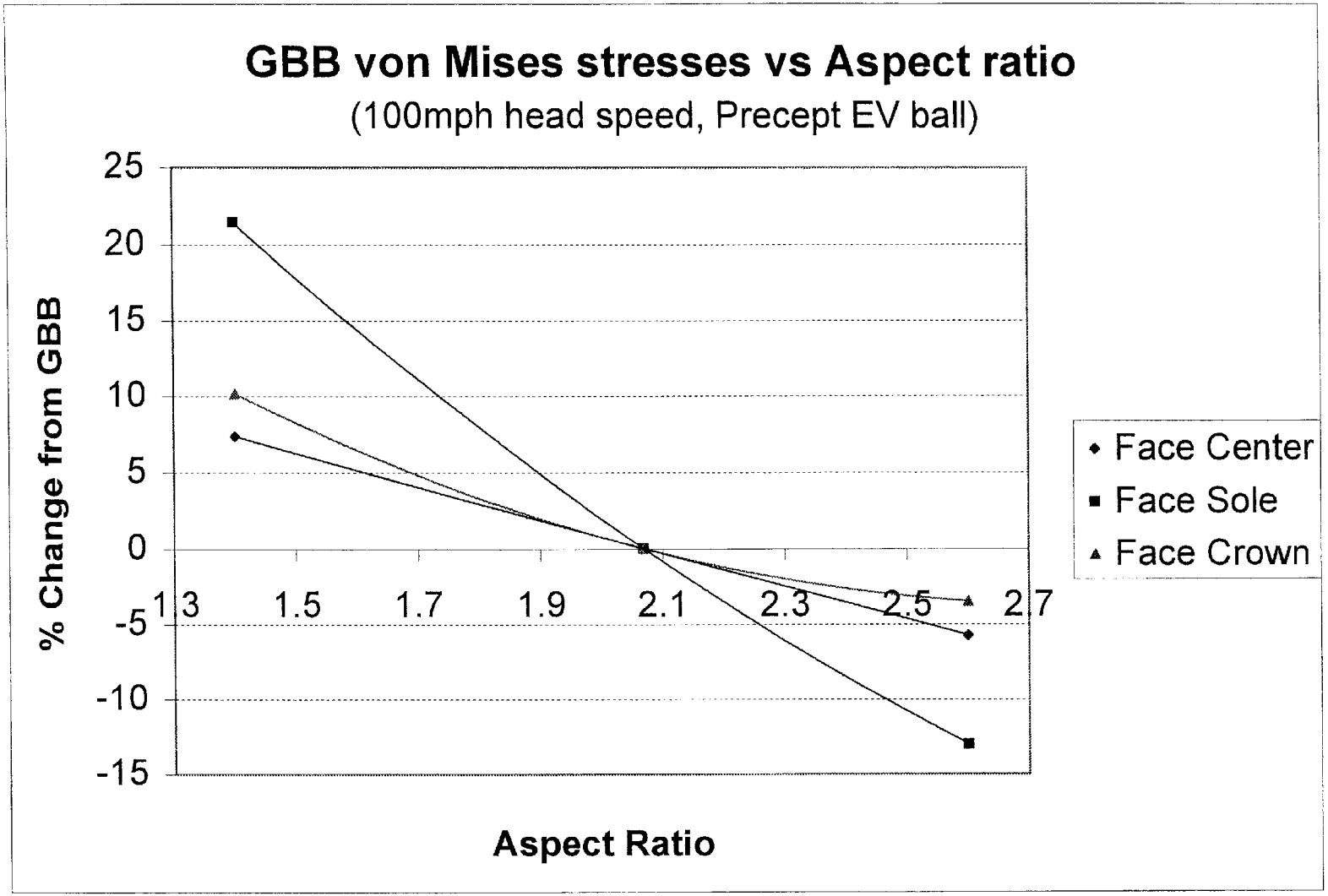
FIG. 22 is a graph of the percentage change in von Mises stresses using a GREAT BIG BERTHA® shaped golf club as a base reference versus Aspect ratio for the face center, the face sole and the face crown of the golf club head of the present invention.

FIG. 22 illustrates the percent changes from the stresses on a GREAT BIG BERTHA® reference versus changes in the aspect ratio of the face plate 72. As the aspect ratio of the face plate 72 becomes smaller or more circular, the stress on the face sole greatly increases whereas the stress on the face-center and the face-crown only increases slightly as the aspect ratio decreases.

Figure 23:
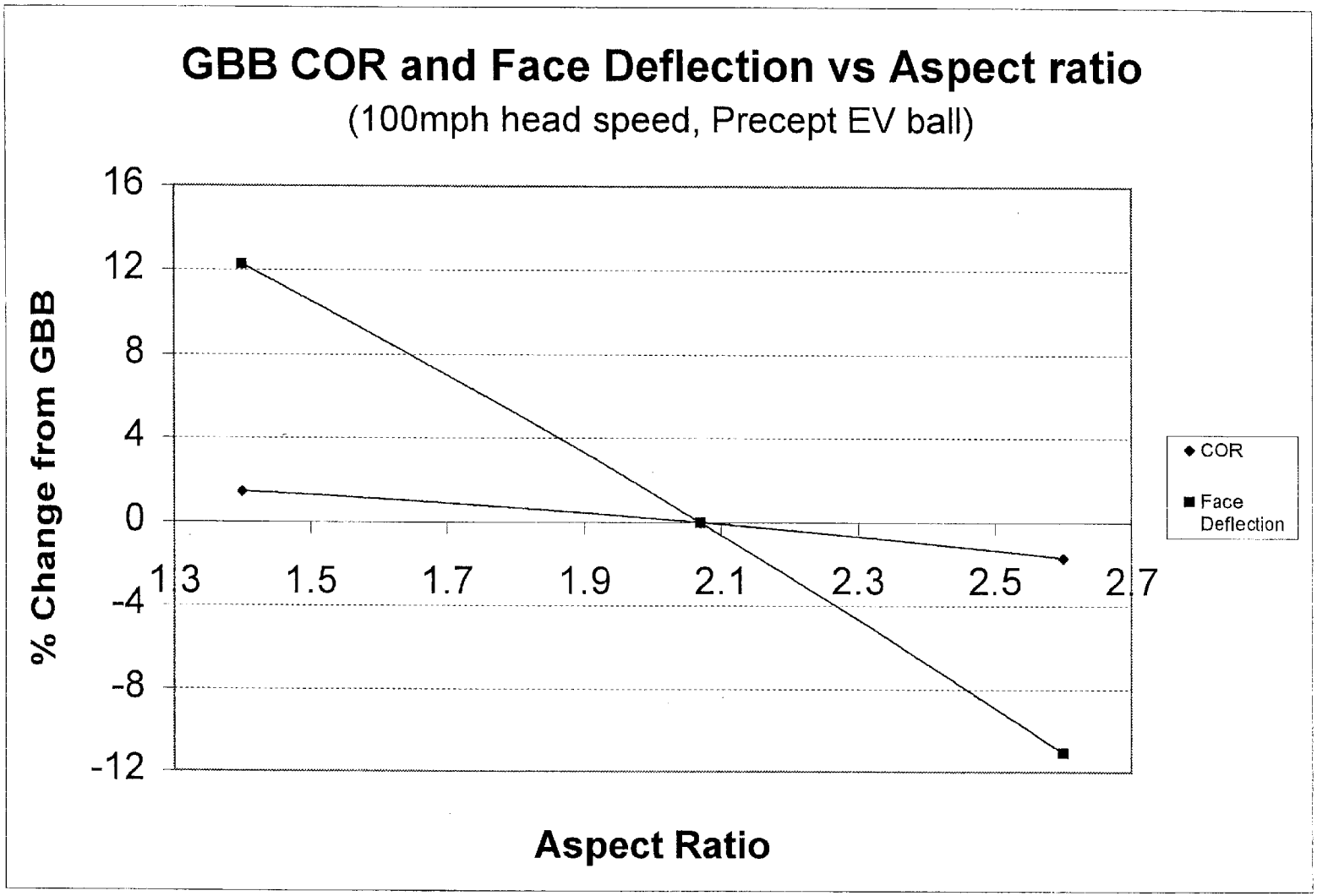
FIG. 23 is a graph of the percentage change in COR and Face Deflection using a GREAT BIG BERTHA® shaped golf club as a base reference versus Aspect ratio.

FIG. 23 illustrates how changes in the aspect ratio will affect the COR and face deflection. Small changes in the aspect ratio will greatly affect the deflection of the face plate 72 while changes to the COR, although relatively smaller percentage changes, are significantly greater in effect. Thus, as the aspect ratio becomes more circular, the face deflection will increase while the COR will increase slightly, but with a significant effect relative to the face deflection.

Figure 24:
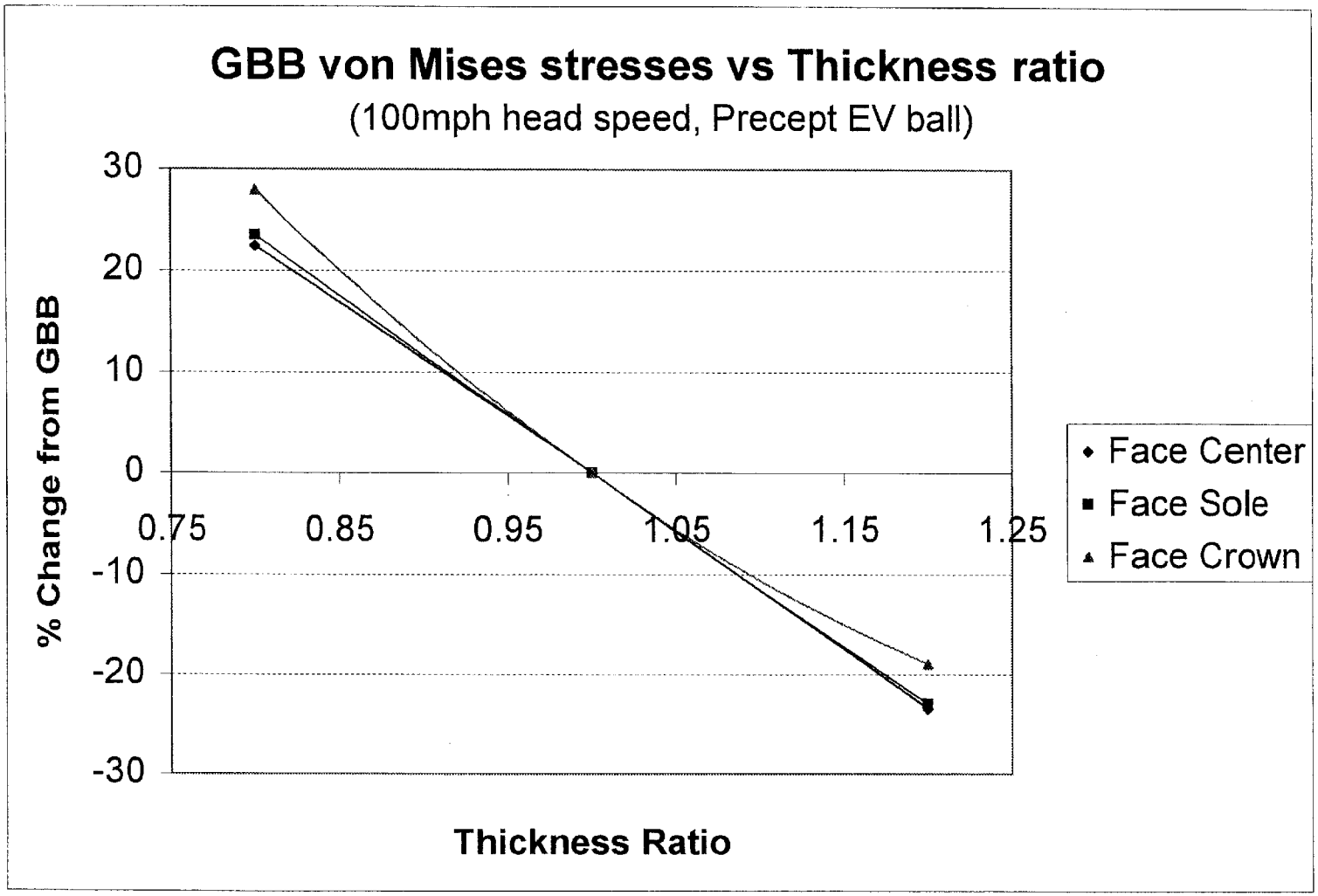
FIG. 24 is a graph of the percentage change in von Mises stresses using a GREAT BIG BERTHA® shaped golf club as a base reference versus Thickness ratio for the face center, the face sole and the face crown of the golf club head of the present invention.

FIG. 24 illustrates the percent changes from the stresses on a GREAT BIG BERTHA® reference versus changes in the thickness ratio. The thickness ratio is defined as the ratio of the face plate 72 to the face thickness of the GREAT BIG BERTHA® reference which has a face thickness of 0.110 inches. As illustrated in the graph, small changes in the thickness ratio will have significant changes in the stress of the face-crown, the face-center and the face-sole.

Figure 25:
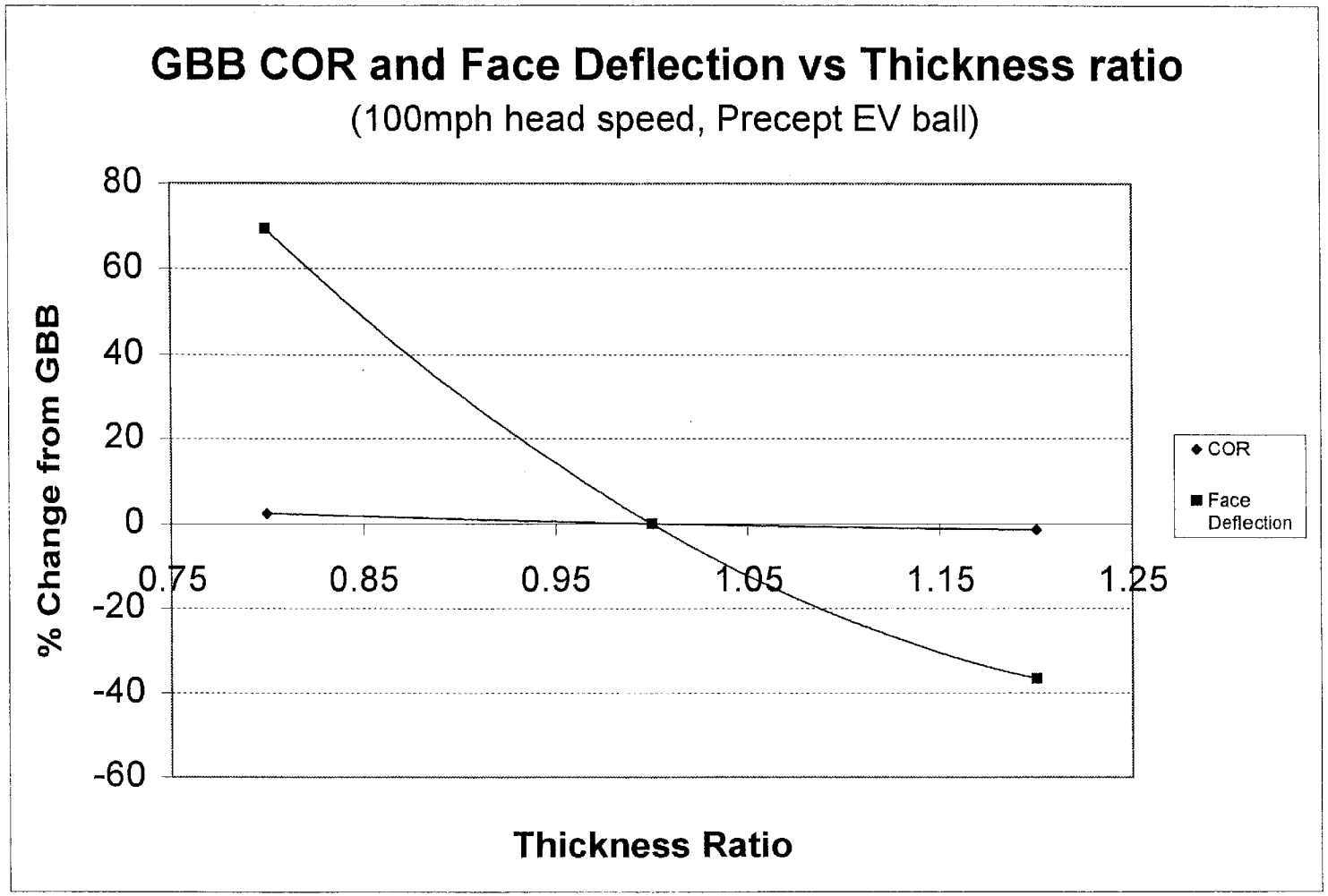
FIG. 25 is a graph of the percentage change in COR and Face Deflection using a GREAT BIG BERTHA® shaped golf club as a base reference versus Thickness ratio.

FIG. 25 illustrates how changes in the thickness ratio will affect the COR and face deflection. Small changes in the thickness ratio will greatly affect the deflection of the face plate 72 while changes to the COR are significantly smaller in percentage changes.

Figure 26:
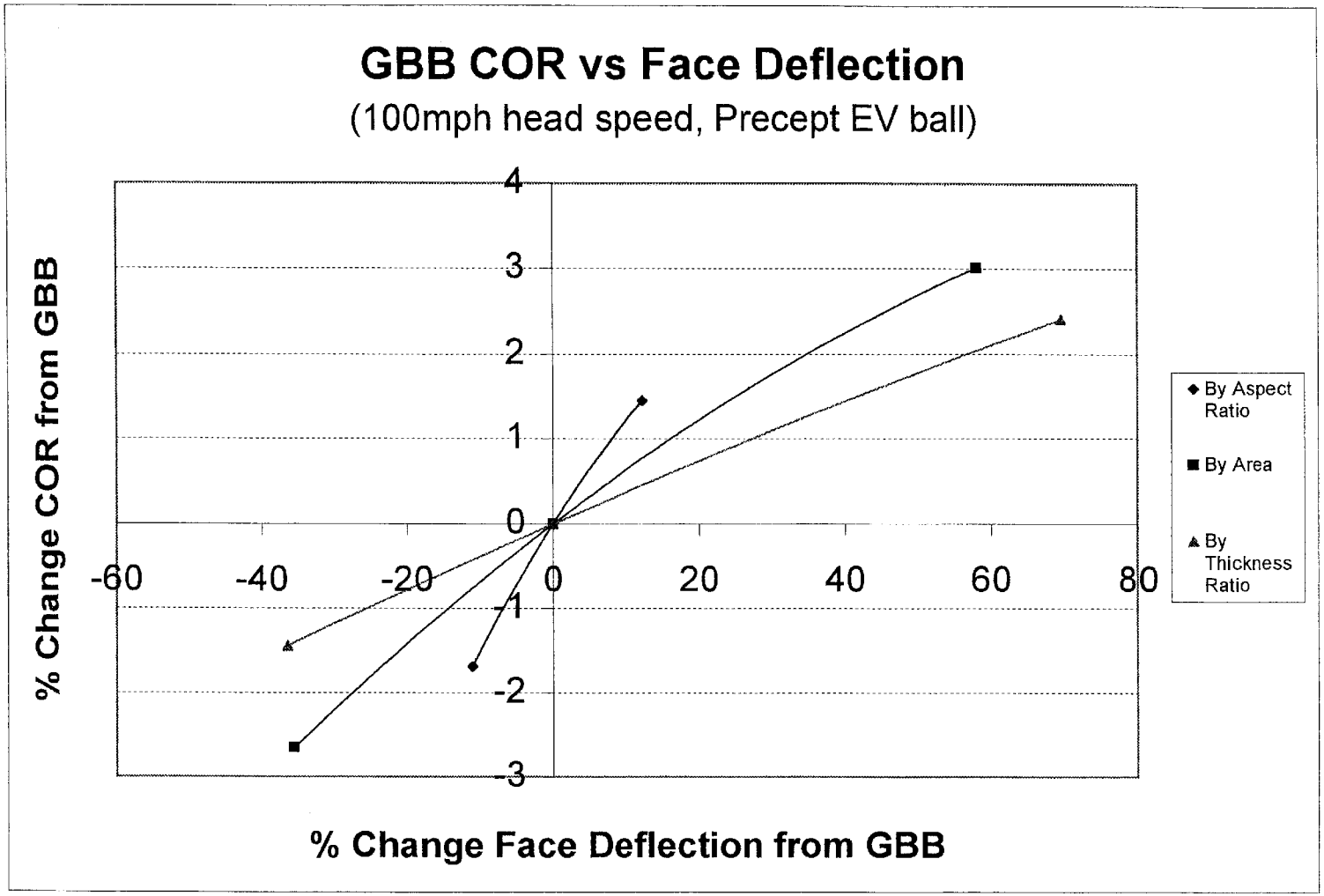
FIG. 26 is a graph of the percentage change in COR using a GREAT BIG BERTHA® shaped golf club as a base reference versus the percentage change in Face deflection using a GREAT BIG BERTHA® shaped golf club as a base reference for the aspect ratio, the area and thickness ratio of a golf club of the present invention.

FIG. 26 combines FIGS. 21, 23 and 25 to illustrate which changes give the greatest changes in COR for a given percentage change in the face deflection. As illustrated, changing the aspect ratio will give the greatest changes in COR without substantial changes in the face deflection. However, the generic shape of a golf club head dictates that greater total change in COR can be practically achieved by changing the area of the face.

Figure 27:
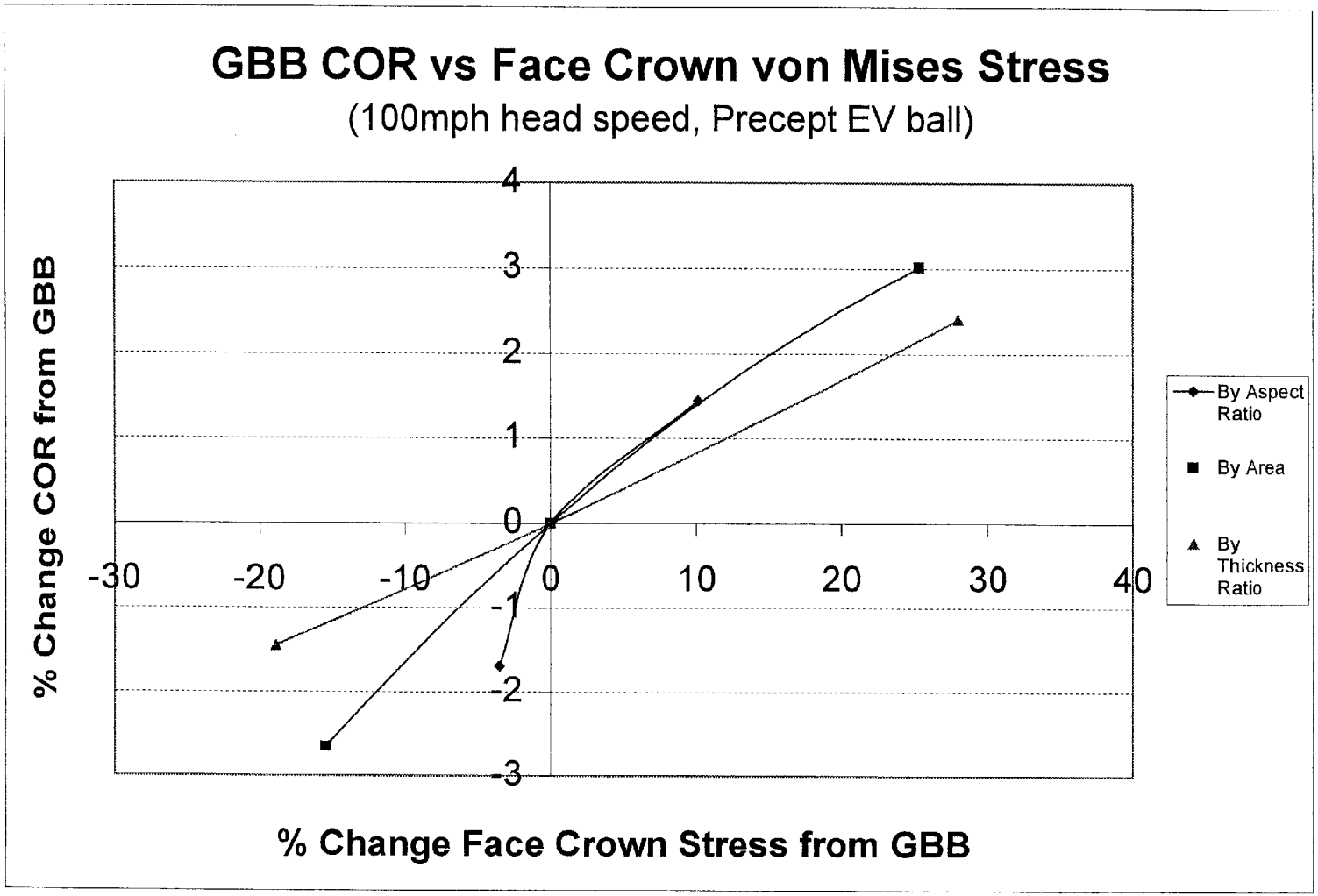
FIG. 27 is a graph of the percentage change in COR using a GREAT BIG BERTHA® shaped golf club as a base reference versus the percentage change in Face crown von Mises stress using a GREAT BIG BERTHA® shaped golf club as a base reference for the aspect ratio, the area and thickness ratio of a golf club of the present invention.

FIG. 27 combines the face-crown results of FIGS. 20, 22 and 24 to illustrate which changes give the greatest changes in COR relative to face-crown stress. As illustrated, changing the aspect ratio will give the greatest changes in COR with the least changes in the face-crown stress. However, changes in the area should be used to obtain the greater overall change in COR.

Figure 28:
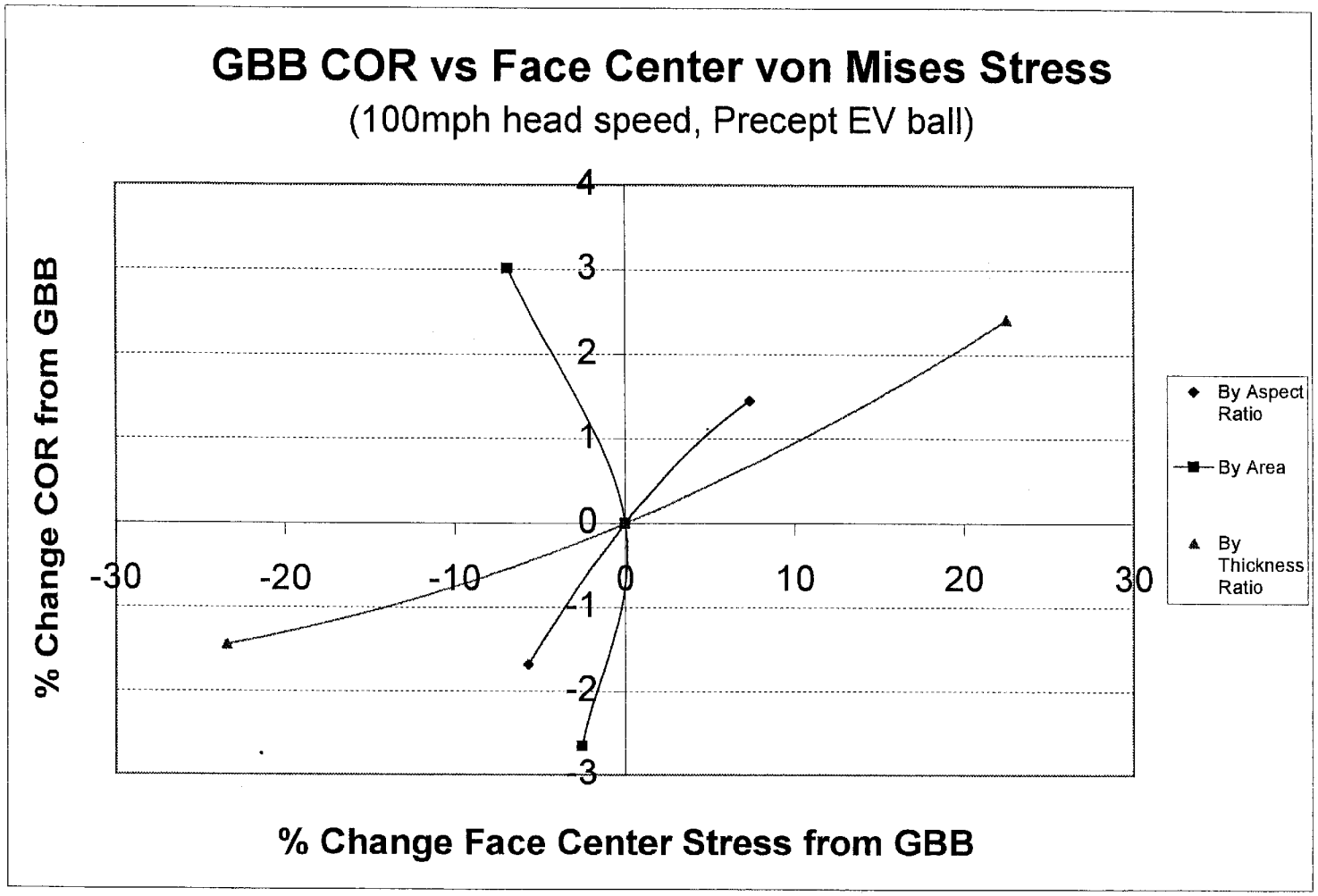
FIG. 28 is a graph of the percentage change in COR using a GREAT BIG BERTHA® shaped golf club as a base reference versus the percentage change in Face center von Mises stress using a GREAT BIG BERTHA® shaped golf club as a base reference for the aspect ratio, the area and thickness ratio of a golf club of the present invention.

FIG. 28 combines the face-center results of FIGS. 20, 22 and 24 to illustrate which changes give the greatest changes in COR relative face-center stress. As illustrated, changing the area will give the greatest changes in COR with the least changes in the face-center stress.

Figure 29:
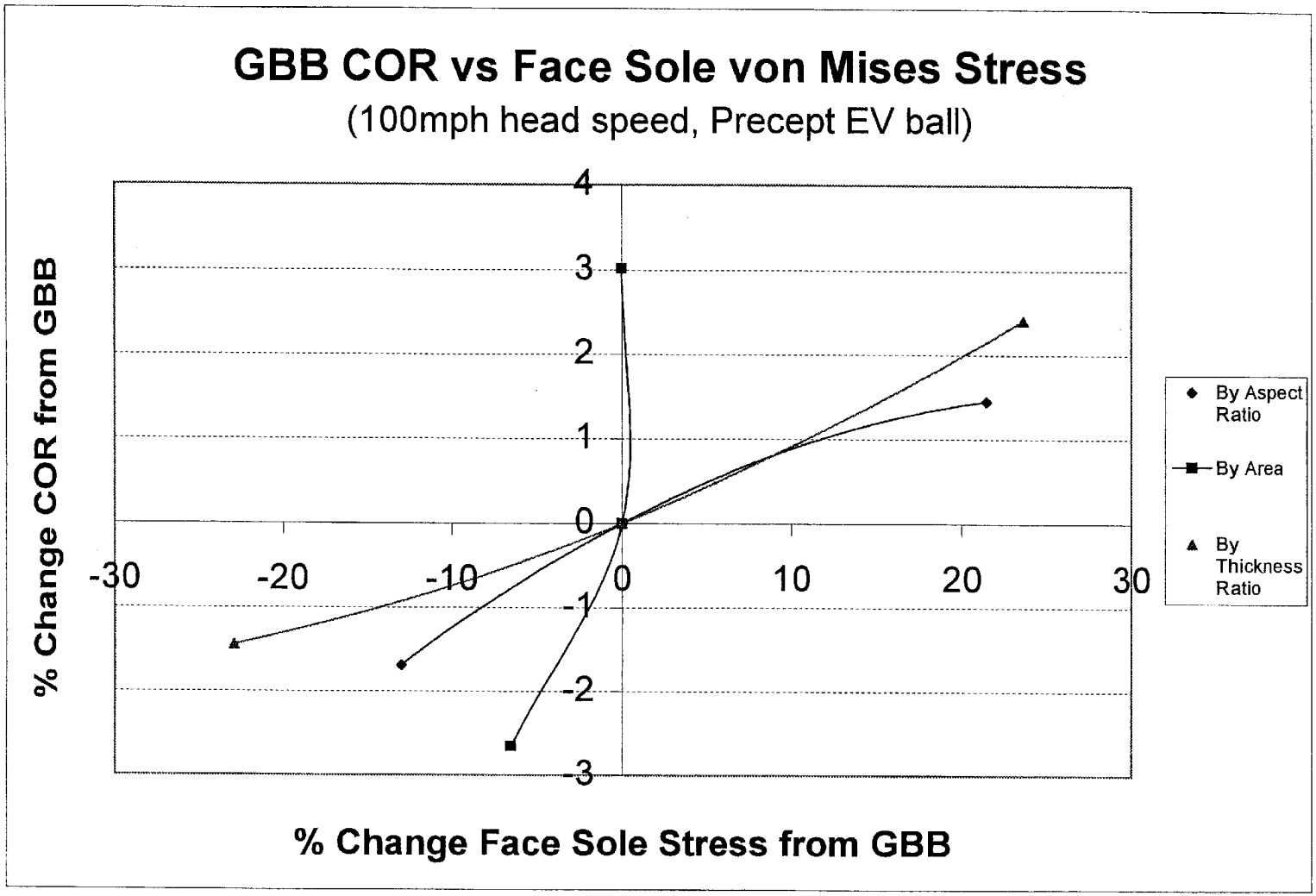
FIG. 29 is a graph of the percentage change in COR using a GREAT BIG BERTHA® shaped golf club as a base reference versus the percentage change in Face sole von Mises stress using a GREAT BIG BERTHA® shaped golf club as a base reference for the aspect ratio, the area and thickness ratio of a golf club of the present invention.

FIG. 29 combines the face-sole results of FIGS. 20, 22 and 24 to illustrate which changes give the greatest changes in COR relative to the face-sole stress. Similar to the results for the face-center, changing the area will give the greatest changes in COR with the least changes in the face-sole stress.

The changes in the thickness ratio provide the least amount of changes in the COR relative to the aspect ratio and the area. However, the golf club head 42 of the present invention utilizes all three, the thickness ratio, the aspect ratio and the area to achieve a greater COR for a given golf ball under test conditions such as the USGA test conditions specified pursuant to Rule 4-1e, Appendix II of the Rules of Golf for 1998–1999. Thus, unlike a spring, the present invention increases compliance of the face plate to reduce energy losses to the golf ball at impact, while not adding energy to the system.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising: a face member composed of a vitreous metal material, the face member comprising a face plate for striking a golf ball having an exterior surface and an interior surface, the face plate extending from a heel section of the golf club head to a toe section of the golf club head, a face extension extending laterally rearward from a perimeter of the face plate; a crown secured to the upper portion of the face extension at a distance ranging from 0.2 inch to 1.0 inch from the perimeter of the face plate; and a sole plate secured to the lower portion of the face extension at a distance ranging from 0.2 inch to 1.0 inch from the perimeter of the face plate.

2. The golf club head according to claim 1 wherein the vitreous metal is selected from the group consisting of iron-boron, nickel-copper, nickel-zirconium and nickel-phosphorous.

3. A golf club head comprising: a face member composed of a vitreous metal material, the face member comprising a face plate for striking a golf ball having an exterior surface and an interior surface, the face plate extending from a heel section of the golf club head to a toe section of the golf club head, a face extension extending laterally rearward from a perimeter of the face plate; a crown secured to the upper portion of the face extension at a distance ranging from 0.2 inch to 1.0 inch from the perimeter of the face plate; and a sole plate secured to the lower portion of the face extension at a distance ranging from 0.2 inch to 1.0 inch from the perimeter of the face plate; wherein the face plate comprises a central circular region having a base thickness ranging from 0.090 inch to 0.110 inch, a first concentric region having a first thickness ranging from 0.082 inch to 0.097 inch wherein the base thickness is greater than the first thickness, a second concentric region having a second thickness ranging from 0.070 inch to 0.94 inch wherein the first thickness is greater than the second thickness, a third concentric region having a third thickness ranging from 0.0.70 to 0.090 inch wherein the second thickness is greater than the third thickness, and a periphery region having a fourth thickness ranging from 0.061 inch to 0.069 inch wherein the fourth thickness is less than the third thickness.

4. A golf club head comprising: a face member composed of a vitreous metal material, the face member comprising a face plate for striking a golf ball having an exterior surface and an interior surface, the face plate extending from a heel section of the golf club head to a toe section of the golf club head, a face extension extending laterally rearward from a perimeter of the face plate, and an interior tubing for receiving a shaft, the interior tubing engaging an upper portion of the face extension and a lower portion of the face extension; a crown secured to the upper portion of the face extension at a distance ranging from 0.2 inch to 1.0 inch from the perimeter of the face plate; and a sole plate secured to the lower portion of the face extension at a distance ranging from 0.2 inch to 1.0 inch from the perimeter of the face plate; wherein the face plate has concentric regions of varying thickness with the thickest region in the center, and wherein the golf club head has a volume no greater than 400 cubic centimeters and a coefficient of restitution of ranging from 0.80 to 0.93 under standard USGA conditions.

5. A golf club head comprising: a face member composed of a vitreous metal material, the face member comprising a face plate for striking a golf ball having an exterior surface and an interior surface, the face plate extending from a heel section of the golf club head to a toe section of the golf club head, a face extension extending laterally inward from a perimeter of the face plate, and an interior tubing for receiving a shaft, the interior tubing engaging an upper portion of the face extension and a lower portion of the face extension; a crown secured to the upper portion of the face extension at a distance ranging from 0.2 inch to 1.0 inch from the perimeter of the face plate; and a sole plate secured to the lower portion of the face extension at a distance ranging from 0.2 inch to 1.0 inch from the perimeter of the face plate; wherein the lower portion of the face extension has a bore section extending about the interior tubing, the bore section having a width greater than the entirety of the lower portion of the face extension; and wherein the golf club head has a volume no greater than 400 cubic centimeters and a coefficient of restitution of ranging from 0.80 to 0.93 under standard USGA conditions.

* * * * *